United States Patent [19]

Bacon et al.

[11] 4,042,467

[45] Aug. 16, 1977

[54] ELECTROLYTICALLY TREATING A SELECTED CYLINDRICAL SURFACE OF AN ARTICLE

[75] Inventors: Duane E. Bacon; J. David Gattermeir, both of Lee's Summit; Spencer S. Hecox, Raytown; John J. Robb, Independence, all of Mo.

[73] Assignee: Western Electric Company, Inc., New York, N.Y.

[21] Appl. No.: 729,437

[22] Filed: Oct. 4, 1976

[51] Int. Cl.[2] ..... C25D 5/02; C25D 17/12; C25D 17/14

[52] U.S. Cl. ..... 204/15; 204/224 R; 204/DIG. 7

[58] Field of Search ..... 204/DIG. 7, 297 W, 15, 204/25, 224 R

[56] References Cited

U.S. PATENT DOCUMENTS

| | | | |
|---|---|---|---|
| 1,280,249 | 10/1918 | Landry | 204/DIG. 7 |
| 2,751,340 | 6/1956 | Schaefer et al. | 204/297 W |
| 3,331,764 | 7/1967 | Beebe, Jr. et al. | 204/297 W |
| 3,891,534 | 6/1975 | Cordone | 204/272 |
| 4,001,093 | 1/1977 | Koontz et al. | 204/15 |

FOREIGN PATENT DOCUMENTS

| | | | |
|---|---|---|---|
| 579,941 | 8/1946 | United Kingdom | 204/DIG. 7 |
| 1,169,225 | 10/1969 | United Kingdom | 204/DIG. 7 |

*Primary Examiner*—T. M. Tufariello
*Attorney, Agent, or Firm*—W. O. Schellin

[57] ABSTRACT

A cylindrical surface of an article is electrolytically treated with a controlled, cross-sectional distribution of the electrolytic action. The distribution is achieved by placing the surface at a predetermined distance from a formed electrode to control the influence of the electrode on each portion of the surface along a cross section thereof. The influence on each such portion with respect to other portions of the surface is determined by the magnitude of an influence number associated with such portion in relation to the magnitude of similar influence numbers associated with the other surface portions along the cross section.

10 Claims, 4 Drawing Figures

ELECTROLYTICALLY TREATING A SELECTED CYLINDRICAL SURFACE OF AN ARTICLE

BACKGROUND OF THE INVENTION

1. Field of the invention

This invention relates broadly to electrolytically treating a selected cylindrical surface of an article. More particularly, the invention relates to controlling the extent of electrolytic action on each portion along a cross section of the surface with respect to the other portions along the cross section. Consequently, the invention is useful in controlling the amount of gold which is selectively deposited over a formed spring of a connector contact.

2. Discussion of the Prior Art

In present day electronic equipment gold is widely used as a surface material on contacts. The excellent conductive properties of gold, and its extreme resistance to corrosion, are highly desirable characteristics of contact surfaces. However, the high cost of gold makes it advantageous to find various ways of limiting its use to precisely defined areas and to attempt to limit its deposits to thicknesses no greater than those necessary to achieve such desirable characteristics. While the present invention relates to plating controlled thicknesses of material onto selected surfaces of articles, such as connector contacts, it must be understood that the description of the invention in relation to such contacts is for illustrative purposes only.

In the prior art, as exemplified by U.S. Pat. No. 3,891,534 to Cordone et al., electrolytic plating systems have been used, for example, to cathodically plate an epitrochoidally-shaped internal surface of a rotary engine housing. An internal cylindrical surface appears to be uniformly platable by a concentric conforming anode. On the other hand, a noncircular cylindrical internal surface, such as one having a reverse curvature, needs a variable anode-to-cathode spacing for a uniform plating thickness over the internal surface of the article. The Cordone et al. patent addresses itself to plating a specific shape of an epitrochoid or compound cathode surface with a reverse curvature. The Cordone et al. disclosure teaches that for the portion of reverse curvature of the cathode, the anode-to-cathode distance is progressively deviating away from conformity and having a maximum deviation in alignment with an extension of a radius passing through the mid point of said reverse curvature. The deviation is taught to be inversely proportional to the square root of the current density.

It is also known to selectively plate areas of a substrate surface with an impinging stream of electrolyte. The method includes the use of a dielectric member maintained between an anode and a cathode which is out of contact with the latter.

It is desirable to improve on the prior art, particularly to improve on the uniformity of the material which is deposited within the selected surface area of the workpiece to be plated. It is further desirable to achieve such uniformity of material deposition in a predetermined area of the workpiece regardless of the amount of curvature in the particular area and independently of the current density at which the workpiece is to be plated.

SUMMARY OF THE INVENTION

It is, therefore, an object of the invention to provide new and improved methods and apparatus for controlling the extent of treatment on a predetermined surface of a workpiece or article.

It is another object of the invention to provide a plating system wherein a predetermined surface of an article becomes uniformly plated.

In accordance with the present invention, a predetermined cylindrical surface area of an article is electrolytically treated by placing the article in an electrolytic bath facing an electrode and then charging the article with a electrical potential with respect to the electrode. The electrode is shaped in a manner, such that sum of ratios, summed along an entire cross section through the electrode has a definite value for each of a plurality of equal unit areas along a cross section of the surface of the article to be plated. This value is determinative of the extent of treatment on the unit areas in relation to each other. The ratios are determined by dividing an incremental surface area of the electrode along the cross section thereof by the distance between the incremental surface area of the electrode to the respective unit area of the article.

According to a more particular aspect of the invention, a plating anode is cylindrical and of an open, circular cross section. The anode is supported in a dielectric housing. The housing is adapted to hold and article to be plated in spaced relationship to the anode, such that adjoining unit areas of the surface of the article along a cross section through the anode are exposed to the anode in a manner wherein a sum of ratios of incremental anode surface areas along the section through the anode, divided by respective distances from the incremental areas of the anode to any one of the unit areas of the article summed along the entire cross section through the anode corresponds proportionately to a similar sum of the other unit areas of the article as a desired amount of plating on the one unit area corresponds to that on the others.

BRIEF DESCRIPTION OF THE DRAWING

The present invention will be more readily understood when the following detailed description is read in conjunction with the appended drawing, wherein.

DETAILED DESCRIPTION

Figure 1:
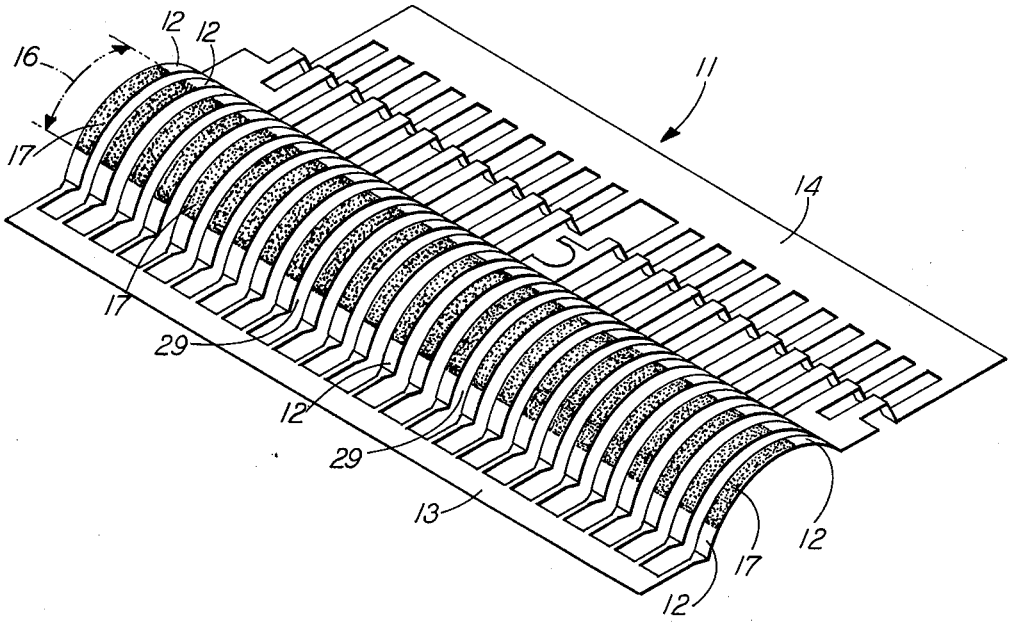
FIG. 1 is a pictorial representation of an article which is ideally plated in accordance with the present invention.

FIG. 1 depicts an article of manufacture such as a connector comb, which is generally designated by the numeral 11. The comb ultimately becomes part of an electrical connector after further processing and assembly steps. Because of the requirements placed on individual contacts 12 of the comb 11, it is an ideal part to be treated in accordance with the present invention. However, it should be understood that the description of the invention in relation to the connector comb 11 is for illustrative purposes only and not for purposes of limitation. The described invention is applicable to depositing various platable metals, e.g., copper, gold, platinum, nickel, etc. on articles other than the described comb 11.

The contacts 12 of the comb 11 are retained in fixed relationship to each other by tie strips 13 and 14. Each of the contacts 12 is formed into a substantially circular, arched shape, whereby it is intended that a convex surface 16 of the arched contact 12 serves as a connector contact surface upon final assembly of the contacts 12 into a connector which is not shown. Consequently, the surface 16 of each contact is subject to a sliding engagement with a mating contact surface as the assembled connector becomes coupled to its complementary contacting element. Since a use of the contact surface 16 in low voltage applications requires low contact resistance, a securely bonded gold film 17 on the surface 16 is a requirement. In addition to low contact resistance, gold possesses a hardness to resist wear, but also to flex and yield when the contact surfaces 16 are coupled to other mating connector elements.

The gold film or layer 17 of substantially uniform thickness is plated onto the surface 16 in a plating cell, generally designated by the numeral 21. The cell 21 is shown in a cross-sectional view in FIG. 2.

The plating cell 21 is housed in a supporting envelope 23 of a suitable dielectric material, such as polypropylene. The envelope 23 includes a base 24 and a lid 26. A cavity 27 extends longitudinally through the base 24. Besides being open at both ends of the base 24, the cavity 27 is accessible along the entire length of the base. The comb 11 is loaded into the plating cell 21 extending the length of the cavity 27. The convex surface 16 of the contacts 12 face the cavity 27. The lid 26 is then placed against the contact comb 11 and a suitable clamp or lock 28 (shown in FIG. 3) moves the lid 26 in the direction of the arrow toward the base 26. The comb 11 is thereby securely clamped so that the surface 16 of contacts 12 faces the cavity 27. The lid 26 closes the longitudinal opening of the cavity 27, particularly spaces 29 (shown in FIG. 1) that exist between the contacts 12.

Figure 3:
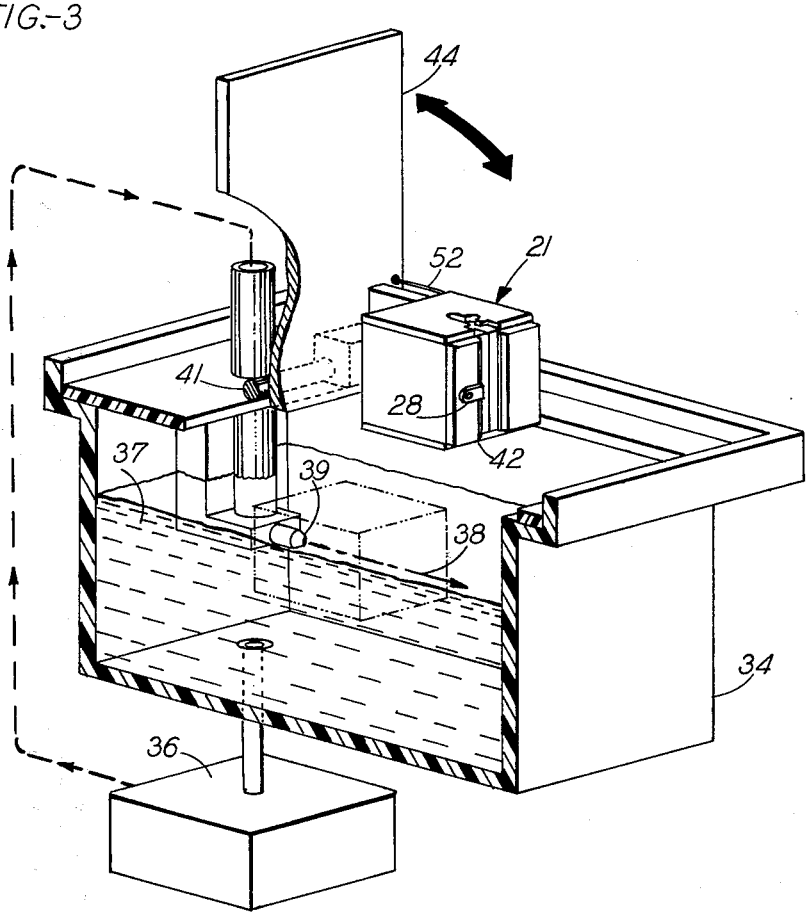
FIG. 3 is a section through a plating apparatus, shown in simplified form, which advantageously employs the anode of FIG. 2 to plate the article of FIG. 1.

Referring briefly to FIG. 3, there is shown a pictorial view of the plating cell 21 in a hinged position above a plating tank 34. A pumping and filtering system 36 for an electrolyte 37 forces a stream 38 of the electrolyte from a nozzle 39 in a direction parallel to the fluid level of the electrolyte in the tank 34. As the plating cell 21 is pivoted about a hinge 41, one of the openings of the cavity 27 in a face 42 moves into coextensive alignement with the nozzle 39. Consequently, the stream 38 of the electrolyte 37 is channeled through the length of the cavity 27.

Also, as the plating cell 21 is fully lowered or pivoted into the tank and the cavity 27 becomes aligned with the nozzle 39, the cell 21 hangs vertically from a cover plate 44. The cover plate 44 seals off the plating tank to prevent splashing or spilling of the electrolyte 37 during a plating operating on the surface 16 of the connector contacts 12. The plating operation is initiated and takes place after the cell 21 has been pivoted into the tank 34.

Figure 2:
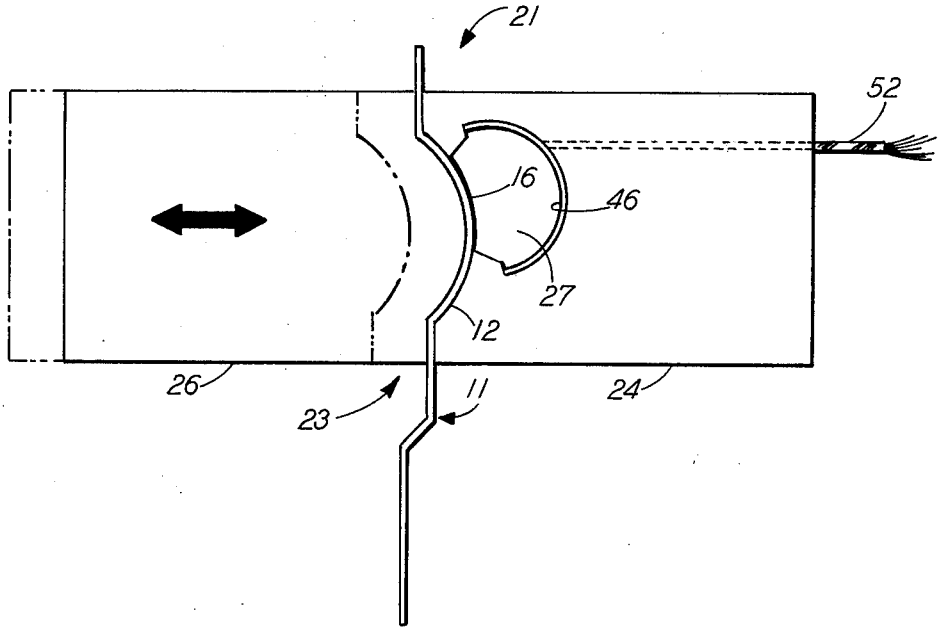
FIG. 2 shows an end view of the article of FIG. 1 and furthermore shows the article in relation to a plating anode which is shaped in accordance with the present invention.
Figure 4:
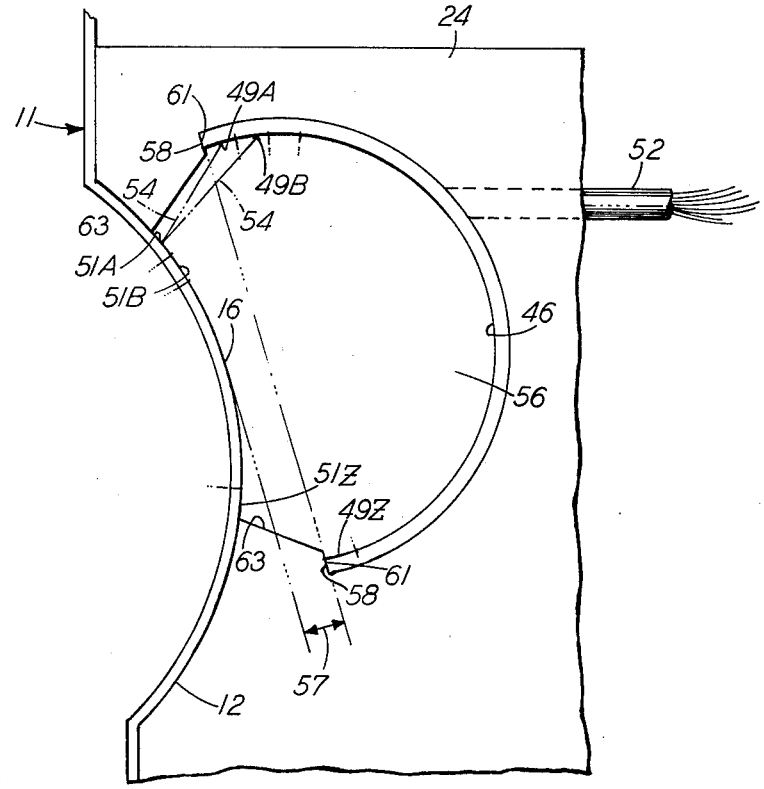
FIg. 4 is an enlarged view of the plating cell of a cross section or end view of the article to be plated in relation to a cross section through the anode in the cell.

A desired uniformity in the layer 17 of deposited material or gold on the surface 16 is achieved by an anode 46 which is located along the length of the cavity 27 in the base 24 of the cell 21. The material of the anode 46 is preferably platinum. The section through the plating cell 21, as shown in FIGS. 2 and 4, illustrate the relation of the plating anode 46 to the surface 16 through which a uniform thickness of plated material is achieved over a desired portion of the contact 12 of the surface 16. The plating anode 46 is mounted along a domed surface 48 of the cavity 27. The cavity 27 itself serves two major functions: (1 ) it serves as a duct for the rapidly flowing electrolyte; and (2 ) it provides a predetermined spacing between each incremental surface area 49 (typically designated by the numeral 49) of the plating anode 46 and each unit area 51 of the surface 16 to be plated.

The flow of electrolyte 37 through the cavity 27 is highly agitated and fully turbulent to minimize boundary layers and to bring about a fast exchange or rejuvenation of the electrolyte within the cell 21. The high degree of agitation and the fast exchange of electrolyte through the cell 21 are factors which are believed to contribute to the ability of the cell 21 to plate economically with high current densities. Current densities in gold plating operations are considered to be high in excess of 90 amps per square foot. The current densities used in conjunction with plating gold onto the surface 16 of the comb 11 are, for example, normally with a range of 200 to 500 amps per square foot, but plating operations with even higher current densities are possible.

The uniformity of the plating thickness over the desired area of the surface 16 on each of the contacts 12 is measured by the difference between the thinnest and the thickest deposition of material on the desired area of the surface 16. Substantial uniformity over the surface 16 of each of the contacts 12 is achieved by subjecting each portion of the surface 16, referred to as one of the unit areas 51, to the same influence by the anode 46, when the anode is electrically charged through a lead 52 with respect to the comb 11. A corresponding electrical connection to the comb 11 is made by a lead (not shown).

When during the plating process the anode 46 is charged with a voltage with respect to the contact comb 11, it appears that each incremental surface area 49 on the anode 46 contributes to the deposition of material onto each of the unit areas 51 of the surface 16. The amount to which each incremental anode area 49 contributes to the deposition of material, varies depending on the separation or distance between the particular incremental area 49 and the unit area 51 on the surface 16.

Referring for the following discussion to the enlarged section through the cell 21 in FIG. 4, it can be seen that the distance between a particular incremental area 49A is less, for instance, to a unit area 51A of the surface 16 than to another unit area 51Z of the same surface. Consequently, the incremental surface area 49A of the anode 46 contributes more to plating the unit area 51A of the contact 12 than to plating the unit area 51Z on the same surface 16 of the contact 12. Conversely, an incremental surface area 49Z of the anode 46 contributes proportionately the same to plating the unit area 51Z as the incremental area 49A contributes to plating the unit area 51A. Similarly, the incremental area 49Z contributes to plating the unit area 51A as the incremental area 49A contributes to plating the unit area 51C.

The domed surface in the base 24 has consequently been shaped to form the anode 46 in such a manner that the summation of the ratios of each incremental surface area of the anode 46 divided by the distance between the particular incremental area to any selected one of the unit areas 51 on the surface 16 is equal or at least substantially equal for all of the unit areas on the surface 16 of the contact 12 to be plated. Ideally, of course, the summation of these ratios should be equal for all incremental portion 51 if it is desired to achieve complete uniformity in the thickness of the plated material on the surface 16. However, a variation in the summation of these ratios amounts to a proportionate difference in the uniformity of the thickness. Therefore, if a slight deviation in the uniformity of the plated thickness is acceptable, then a similar deviation in the sum of the referred-to ratios among the respective unit areas 51 is also acceptable.

In general, the extent of electrolytic action on any one unit area 51 of the contacts 12 relative to the electrolytic action on the other unit areas 51 of the contacts is proportional to the magnitude of influence numbers associated with each of the unit areas. The influence number for each of the unit areas 51 is determined by first ascertaining the distances between the incremental areas 49 of the anode 46 and one of the unit areas 51. The influence number is the sum of the ratios of each of the incremental areas 49 divided by its respective distance to the one unit area 51 summed over the entire anode 46 along the cross section as shown in FIGS. 2 and 4.

For instance, referring to FIG. 4, the influence number for one of the unit areas 51 is determined by first dividing the cross section of the anode 46 into equal parts which represent the cross sectional dimension of the incremental surface areas 49 of the anode. A convenient number should be chosen for the divisional parts which are labelled here, for exemplary purposes only, from A to Z.

Thereafter, distances 54 are measured from the center of each of the incremental areas 49, represented by the divisional parts to, for instance, the unit area 51A on the surface 16. The reciprocal or inverse of each of the distances are then summed for each of the incremental areas 49 (49A to 49Z in FIG. 4) to obtain the influence number for the unit area 51A on the surface 16 of the contact 12. The ratio conveniently includes each of the incremental surface areas 49 as unity. This is permissible, since the influence numbers for each of the unit areas of the surface 16 are used in conjunction with each other to a proportional influence of the anode 46 on each of the unit areas of the surface 16. The relative magnitude of the influence numbers with respect to each other results in a profile over the surface 16 which is indicative of the extent of the electrolytic plating action on each of the unit areas (51A to 51Z) of the surface 16 of each of the contacts 12.

In the preferred embodiment described herein these influence numbers are substantially equal for all unit areas 51. Consequently, the deposited material is expected to be of substantially uniform thickness over the portion 47 of each contact 12, with a possible slight increase toward the center of the surface 16.

The shape of the anode 46 is preferably a longitudinal section of a right circular cylinder which is fitted against the domed surface 48 of the cavity 27. The anode 46 covers a substantial portion of the walls of the cavity 27, and the included angle of the circular arc established by the cross section through the anode represents a major portion of the cross-sectional area 56 of the cavity 27. A remaining portion of the area 56 is established substantially by a separation distance 57 between the surface 16 and lower edges 58 of the anode 46. The size of the cross sectional areas 56 determines to some extent flow characteristics and velocities of the electrolyte 37 through the cavity 27. A selection of the radius of the anode 46 also takes into effect the cross sectional size and the curvature of the area to be treated.

Once the size of the circular section of the anode 46 has been established, the separation distance 57 can be adjusted to obtain substantial uniformity in the summation of the ratios of the incremental areas 49 divided by the distance to the respective unit areas 51 on the surface 16. The included angle of the arc through which the anode 46 extends may also be varied to increase the separation distance 57 enough to prevent the portion 47 on the surface 16 from the shielding itself through its own curvature. Possible current concentrations from each of the lower edges 58 of the anode 16 are minimized or avoided by recessing both lower edges 58 of the anode 46 behind a ledge 61 at one end of each of the walls 63 which space the comb 11 from the anode 46.

In general, the cross-sectional shape of the anode need not be circular, and depending on the shape of the surface to be treated in many instances the anode cannot be circular. This particularly so if the portion 47 has a compound curvature. Furthermore, for the anode 46 to correspond to the principles described herein, the cross-sectional shape of the anode 46 does not conform to the shape of the portion 47 to be plated. Such a non-conformance will exist in most anodes formed in accordance with the present invention.

It must also be kept in mind that the development of the appropriate shape for the anode 46 with respect to the precise shape of the portion 47 in accordance with the principles described herein is applicable without modification only to a cylindrical shape of the surface 16 to be plated, even though a cross section through the cylindrical shape may be straight, circular, or comprised of reverse and compound curvatures. The terms "cylinder" and "cylindrical" are therefore used herein in the sense that a cylindrical surface is generated by straight line moving parallel to a straight line and intersecting a curve. The curve may even include a sharp corner as, for instance, the apex of an angle. Consequently, in reference to the disclosed embodiment, sections parallel to the views in FIGS. 2 and 4 result in identical representations of the anode 46. Also, as seen in FIG. 1, all of the contacts 12 are identical in shape and size when viewed in a plane perpendicular to the length of the comb 11.

However, each of the contacts 12 is discrete and spaced from its adjacent contacts. Therefore, even though the comb 11 has been treated as being continuous in the direction of the cylindrical length of the cavity 27, it is not. But variations in the thickness of the plated material perpendicular to the section in FIG. 4 have been found to be negligible over substantially the entire length of the comb 11.

It is, however, known that anodes exhibit end effects which tend to result in a greater amount of electrolytic action from both extremes of, for example, the anode 46 at the face 42 of the base and at an opposite face 63 (shown in FIG. 3). These end effects have been minimized in terminating the length of the anode 46 approximately one half of the width of one of the contacts 12 short of the ends 66 of the comb 11. This was done by optimization in a routine manner in accordance with prior art practices. Also, the end effects of the anode 46 were further minimized by shielding the edges of the anode 46 near the faces 42 and 63 by ledges (not shown) similar to the ledges 61 in FIG. 4.

Irregularities in the spacing of contacts 12 or other irregularities along the length of cylindrical parts to be treated would also cause variations in the extent of the treatment in center portions among adjacent contacts 12 or on other areas located adjacent the irregular discontinuities of the surface to be treated. These variations may best be minimized in accordance with known practices of selectively masking or eliminating portions of the anode 46 which are bonded by parallel sectional planes perpendicular to the length of the anode 46.

However, even in the presence of longitudinal variations in plating action, the cross-sectional distribution of plating occurs in accordance with the principles described herein. For compound curvatures of surface portions to be plated, complete uniformity of material deposition across the cross section of the surface may not always be achievable. Even then, it is possible to approximate the deviation from a uniform layer of plated metal which can be expected.

Consequently, many modifications of the described embodiments are possible without departing from the spirtit and scope of the invention set forth by the appended claims.

What is claimed is:

1. A method of electrolytically treating a cylindrical surface portion of an article with a controlled distributional profile of electrolytic treating action along a section perpendicular to a cylindrical axis of the surface portion, which comprises:

placing the article opposite an electrode of the treating apparatus; locating with respect to a surface of the electrode, typical unit areas of the surface of the article lying adjacent each other along the section in accordance with influence numbers for each of the unit areas, the influence numbers having magnitudes in proportion to the desired extent of the treating action on the unit areas to which such numbers relate, each number being the sum of ratios of incremental areas of the surface of the electrode divided by the respective distances from such incremental areas to the one unit areas associated with the number, summed over the surface of the electrode;

introducing a electrolyte in the space between the article and the electrode; and applying a voltage between the electrode and the surface portion of the article to initiate the desired treating action.

2. A method according to claim 1, wherein the electrode is an anode and the treating action is a metal plating action.

3. A method according to claim 2, wherein the anode is a section of a hollow cylindrical surface, and locating the unit areas of surface portion of the article with respect to a surface of the electrode comprises:

positioning the surface of the article against a longitudinal opening of a cylindrical cavity which houses the anode along a domed surface opposite the opening; and clamping the article aginst the opening with a member to form a longitudinal enclosed channel between the anode and the surface of the article.

4. A method according to claim 3, wherein introducing an electrolyte in the space between the article and the anode comprises flowing an electrolytic fluid longitudinally through the channel.

5. A method according to claim 4, wherein the flow is fully turbulent.

6. A method according to claim 2, wherein the influence numbers for each of the unit areas of the surface portion are substantially equal.

7. In a method of electrolytically treating a predetermined cylindrical surface of an article, wherein the article is placed into an electrolytic bath opposite, spaced from and parallel to a cylindrical electrode, and the electrode is electrically charged with respect to the surface of the article, an improvement wherein a cross section through the electrode is shaped in a predetermined manner with respect to a shape of the surface of the article formed by a plurality of adjoining unit areas of the surface along the plane of the cross section and the method comprises:

positioning the surface of the article opposite the electrode to expose each unit area of the surface to the electrode, such that for any one such unit area of the surface a sum of ratios of incremental surface areas of the electrode in the plane of the cross section divided by distances between such respective incremental areas and the one unit area summed for all such incremental areas of the electrode bears the same relationship to such sum for any of the other unit areas as the desired extent of treatment on such on unit area of the surface bears to the desired extent of treatment on the other unit areas of the surface.

8. A method of controlling a material deposition rate along a typical cross section through a cylindrical surface portion of an article to a predetermined deposition profile along the cross section, which comprises:

placing the surface portion opposite a formed cylindrical anode; and spacing each unit area of the surface portion of the article located along the cross section from all incremental surface areas of the anode to which such unit area is exposed to form a sum for each unit area of the inverse of the distances from all incremental surface areas of the anode to the respective unit area, such sum being proportional in magnitude to the desired deposition rate on the respective unit area as the magnitude of each of the sums formed for the other unit area of the surface portion of the article are proportional to the desired deposition rates thereon as determined by the profile.

9. A plating apparatus, which comprises:

a housing having a cylindrical cavity parallel one face thereof, the face having a longitudinal opening extending the length of the cavity;

a cylindrical anode having an open cross section located within the cavity of the housing and facing the longitudinal opening in the housing; and means for positioning an article with a surface portion to be plated against the longitudinal opening, to locate the surface of the article opposite the anode, the anode having a cross-sectional shape with respect to the surface portion of the article exposed to the anode to separate each unit area of the surface portion of the article located along a typical section through the anode and the article perpendicular to a cylindrical length of the surface portion of the article and of the anode from all incremental surface areas of the anode by a distance, such that a sum of the inverse of the distances from all such incremental surface areas of the anode to the respective unit area results in a number of a magnitude which is proportional to the magnitude of the numbers obtained for the other unit areas of the surface portion of the article as the desired amount of plating on the respective unit area is proportional to the desired amount of plating on such other unit areas of the surface portion of the article.

10. A plating apparatus according to claim 9, wherein the anode is of a circular shape and the surface portion of the article is of a convex arcuate shape, and the positioning means is adapted to space the surface portion at a distance from the anode at which the incremental distances from the anode to the unit area of the surface portion of the article results in numbers of substantially equal magnitude for each of such unit areas.

* * * * *